US011754315B2

(12) United States Patent
Shichi et al.

(10) Patent No.: US 11,754,315 B2
(45) Date of Patent: Sep. 12, 2023

(54) GAS MANIFOLD

(71) Applicant: Rinnai Corporation, Aichi (JP)

(72) Inventors: Kazuyuki Shichi, Aichi (JP); Kunio Kataoka, Aichi (JP)

(73) Assignee: Rinnai Corporation, Aichi (JP)

( * ) Notice: Subject to any disclaimer, the term of this patent is extended or adjusted under 35 U.S.C. 154(b) by 310 days.

(21) Appl. No.: 17/149,372

(22) Filed: Jan. 14, 2021

(65) Prior Publication Data

US 2021/0293183 A1 Sep. 23, 2021

(30) Foreign Application Priority Data

Mar. 17, 2020 (JP) ..... 2020-047011

(51) Int. Cl.
*F23D 14/48* (2006.01)
*F24H 1/00* (2022.01)
*F23K 5/00* (2006.01)

(52) U.S. Cl.
CPC ..... *F24H 1/00* (2013.01); *F23D 14/48* (2013.01); *F23K 5/00* (2013.01)

(58) Field of Classification Search
CPC ..... F23D 14/045; F23D 14/48; F23D 2900/14641; F23D 2900/14003; F23K 5/00; F24H 1/00
USPC ..... 122/13.01
See application file for complete search history.

(56) References Cited

U.S. PATENT DOCUMENTS 3,644,099 A * 2/1972 Crans ..... C01B 3/382 422/204
2021/0071907 A1* 3/2021 Park ..... F23D 14/045

FOREIGN PATENT DOCUMENTS

JP H8-086416 A 4/1996
JP 2019-002594 A 1/2019

* cited by examiner

*Primary Examiner* — Steven B McAllister
*Assistant Examiner* — John E Bargero
(74) *Attorney, Agent, or Firm* — Nakanishi IP Associates, LLC

(57) ABSTRACT

A gas manifold allows each distribution chamber to be fed with fuel gas at an appropriate flow rate irrespective of an increase in the number of distribution chambers included in the gas manifold. Fuel gas flowing through in an inlet is distributed to a plurality of distribution chambers through a main channel. A bypass channel parallel with the main channel also feeds fuel gas to a maximum distribution chamber. This can prevent the feeding of the fuel gas to the maximum distribution chamber from being affected by and reduced by the feeding of the fuel gas to the bypassed distribution chambers. This also prevent the feeding of the fuel gas to the other distribution chambers from being affected by and reduced by the feeding of the fuel gas to the maximum distribution chamber. The plurality of distribution chambers are thus fed with fuel gas at appropriate flow rates.

6 Claims, 7 Drawing Sheets

| Distribution chamber | Number of burners fed with fuel gas |
|---|---|
| Distribution chamber 102a | 4 |
| Distribution chamber 102b (Minimum distribution chamber) | 2 |
| Distribution chamber 102c (Maximum distribution chamber) | 9 |

GAS MANIFOLD

BACKGROUND OF INVENTION

Field of the Invention

The present invention relates to a gas manifold for distributing fuel gas to a plurality of burners in a combustion apparatus that performs stepwise switching of the number of burners to burn the fuel gas among the plurality of burners included in the combustion apparatus.

Background Art

Hot-water supply systems and heating systems incorporate a combustion apparatus for burning fuel gas. The combustion apparatus includes a plurality of burners that are individually fed with fuel gas through their corresponding nozzles. The combustion apparatus also performs stepwise switching of the number of burners to burn the fuel gas. In accordance with intended thermal power, the apparatus increases or decreases the number of burners to be used for burning the fuel gas.

Each burner is fed with fuel gas through the corresponding nozzle. Thus, stepwise switching of the number of burners to burn the fuel gas involves stepwise switching of the number of nozzles to feed the fuel gas. A multi-burner combustion apparatus includes a gas manifold for distributing fuel gas to each burner, and the manifold has the structure below. The gas manifold has an internal main channel allowing passage of fuel gas fed from outside. The main channel branches into a plurality of distribution channels that are connected to distribution chambers via electromagnetic on-off valves. The nozzles for feeding the burners with fuel gas each receive the fuel gas from one of the distribution chambers.

In the gas manifold with the above structure, when the main channel is fed with fuel gas, the fuel gas flows into the distribution chamber connected to a distribution channel with its electromagnetic on-off valve open. The fuel gas is then fed through the nozzles to the burners. In contrast, the fuel gas does not flow into the distribution chamber connected to a distribution channel with its electromagnetic on-off valve closed. The nozzles that receive fuel gas from the distribution chamber are fed with no fuel gas, and thus the burners are also fed with no fuel gas. In this structure, the number of burners to burn fuel gas may be switched in a stepwise manner by switching the open or closed states of the electromagnetic on-off valves in the switch distribution channels.

The number of burners fed with fuel gas from each distribution chamber is set differently for each distribution chamber. This is because switching the distribution chambers for feeding fuel gas to burners causes switching the number of burners to burn the fuel gas, thus causing the thermal power to be changed to multiple levels. An example with nine burners and three distribution chambers will be described. With each distribution chamber including three burners assigned, the burners for burning fuel gas may be switched between three, six, and nine burners, which are three sets of burners, by changing the number of distribution chambers that feed the fuel gas. However, the nine burners may also be divided into two, three, and four burners. These burner sets may be assigned to the distribution chambers. In this case, the number of burners may be changed to switch between seven thermal power levels depending on the selection of a distribution chamber or the combination of distribution chambers.

With each distribution chamber including a different number of burners assigned in this manner, the flow rate of the fuel gas to be fed to each distribution chamber also depends on the distribution chamber. In the above example, the distribution chamber with four burners is to be fed with fuel gas at a flow rate twice as much as for the distribution chamber with two burners. Thus, techniques for feeding fuel gas at an appropriate flow rate to each distribution chamber have been developed using the electromagnetic on-off valves with different sizes in the distribution channels or installing different-sized orifices in the distribution channels depending on the flow rate of the fuel gas to be fed to each distribution chamber (Patent Literatures 1 and 2).

CITATION LIST

Patent Literature

Patent Literature 1: Japanese Unexamined Patent Application Publication No. 8-086416

Patent Literature 2: Japanese Unexamined Patent Application Publication No. 2019-002594

SUMMARY OF INVENTION

However, recent combustion apparatuses may perform switching between more sets of burners to regulate the thermal power more precisely. In this case, feeding each distribution chamber with fuel gas at an appropriate flow rate has become more difficult for the reasons described below. More sets of switchable burners mean more distribution chambers included in the gas manifold. The number of burners fed with fuel gas from each distribution chamber is set differently for each distribution chamber as described above. The increasing number of distribution chambers widens the difference in the number of burners between the distribution chamber including the smallest number of burners and the distribution chamber including the largest number of burners, and increases the difference between the flow rates of fuel gas to be fed. A largely increasing flow rate difference may cause difficulty in feeding each distribution chamber with fuel gas at an appropriate flow rate.

In response to the above issue with the known techniques, one or more aspects of the present invention are directed to a gas manifold that allows each distribution chamber to be fed with fuel gas at an appropriate flow rate irrespective of an increase in the number of internal distribution chambers.

A gas manifold according to one aspect of the present invention has the structure below. The gas manifold is installable in a combustion apparatus to distribute fuel gas to a plurality of burners for burning the fuel gas included in the combustion apparatus. The plurality of burners are grouped into a plurality of burner sets. The combustion apparatus performs stepwise switching of the number of burners to burn the fuel gas by causing each of the plurality of burner sets to burn the fuel gas. The gas manifold includes an inlet that receives the fuel gas fed from outside, a main channel that allows passage of the fuel gas flowing in through the inlet, a plurality of distribution chambers, each located for a corresponding burner set of the plurality of burner sets, that receive, from the main channel, the fuel gas to be fed to the plurality of burners in the plurality of burner sets, a plurality of nozzles, each located for a corresponding burner of the plurality of burners, that feed the plurality of burners with the fuel gas flowing into the plurality of distribution chambers, a plurality of distribution channels branching from the main channel and connecting the main channel to the plurality of distribution chambers, a plurality of on-off valves located at the plurality of distribution channels to open or close the plurality of distribution channels (i.e., a plurality of on-off valves each located at a corresponding distribution channel of the plurality of distribution channels to open or close the corresponding distribution channel), and a bypass channel branching from the main channel downstream from the inlet, bypassing a branch of at least one of the plurality of distribution channels from the main channel, and rejoining the main channel.

In the gas manifold according to the aspect, the fuel gas to be fed to the burners flows into the main channel through the inlet, and is distributed to the plurality of distribution chambers through the distribution channels branching from the main channel. The fuel gas is then fed from each distribution chamber to the burners through the nozzles. The main channel has the bypass channel, which branches from the main channel downstream from the inlet, bypasses the branch of at least one distribution channel from the main channel, and rejoins the main channel.

In this aspect, among the distribution channels branching from the main channel, the distribution channel branching from the main channel downstream from the rejoining point of the bypass channel is fed with fuel gas from the bypass channel as well as the main channel. The bypass channel, which bypasses at least one distribution channel, allows stable feeding of fuel gas irrespective of feeding of fuel gas to the bypassed distribution channel. The plurality of distribution chambers are thus fed with fuel gas at appropriate flow rates.

In the gas manifold according to the above aspect, the bypass channel may rejoin the main channel upstream from a branch of a maximum distribution channel from the main channel. The maximum distribution channel is a distribution channel connected to a maximum distribution chamber (the distribution chamber including more burners in the corresponding burner set than the other distribution chambers).

In this aspect, the maximum distribution chamber is fed with fuel gas from the bypass channel as well as the main channel. The maximum distribution chamber is thus fed with the fuel gas at a stable flow rate although the gas manifold includes a larger number of distribution chambers. The fuel gas fed to the distribution channel bypassed by the bypass channel is also less likely to be affected by the feeding state of fuel gas into the maximum distribution chamber, thus allowing fuel gas to be fed at a stable flow rate. The plurality of distribution chambers are thus fed with fuel gas at appropriate flow rates.

In the gas manifold according to the above aspect, the bypass channel may rejoin the main channel upstream from a branch of the maximum distribution channel from the main channel, and downstream from a branch of a minimum distribution channel. The minimum distribution channel is a distribution channel connected to a minimum distribution chamber (the distribution chamber including fewer burners in the corresponding burner set than the other distribution chambers).

In this aspect, the flow rate of fuel gas into the minimum distribution chamber may not be varied depending on the feeding state of fuel gas into the maximum distribution chamber. The minimum distribution chamber is thus also fed with fuel gas at an appropriate flow rate stably.

In the gas manifold according to the above aspect, a branch of the maximum distribution channel from the main channel may be at an outer side (end position) of other branches of the other distribution channels from the main channel. The bypass channel may rejoin the main channel between the branch of the maximum distribution channel from the main channel and a branch of a distribution channel adjacent to the maximum distribution channel from the main channel.

In this aspect, fuel gas flowing in the bypass channel is mainly fed into the maximum distribution chamber, allowing the maximum distribution chamber to be fed with fuel gas at a sufficient flow rate stably.

In the gas manifold according to the above aspect, the main channel, the plurality of distribution chambers, and the inlet receiving fuel gas may be located as described below. A manifold body may include a channel groove, and a plurality of recesses adjacent to the channel groove. A manifold cover may be fitted to the manifold body, with a sealing member located between them, to be placed over the channel groove to define the main channel, and over the plurality of recesses to define the plurality of distribution chambers. The sealing member may be shaped to cover the channel groove on the manifold body and have a first hole and a second hole at different positions along the channel groove. The manifold cover may have, adjacent to the seal member, a bypass groove connecting to the channel groove on the manifold body through the first hole and the second hole in the sealing member to define the bypass channel.

In this aspect, the bypass groove located on the manifold cover and the first hole and the second hole located in the sealing member allow the bypass channel to be defined easily without changing the shape of the manifold body. In addition, the manifold body uses no space for the bypass channel and may thus be designed easily.

In the gas manifold according to the above aspect, the inlet that receives the fuel gas flowing into the main channel may be open from the manifold body to the manifold cover.

In this aspect, after flowing in through the inlet, hitting the manifold cover, and changing direction, the fuel gas flows along the manifold cover and the sealing member. Thus, the fuel gas is reliably guided to the bypass channel, allowing the maximum distribution chamber to be fed with fuel gas at a sufficient flow rate.

DETAILED DESCRIPTION

Figure 1:
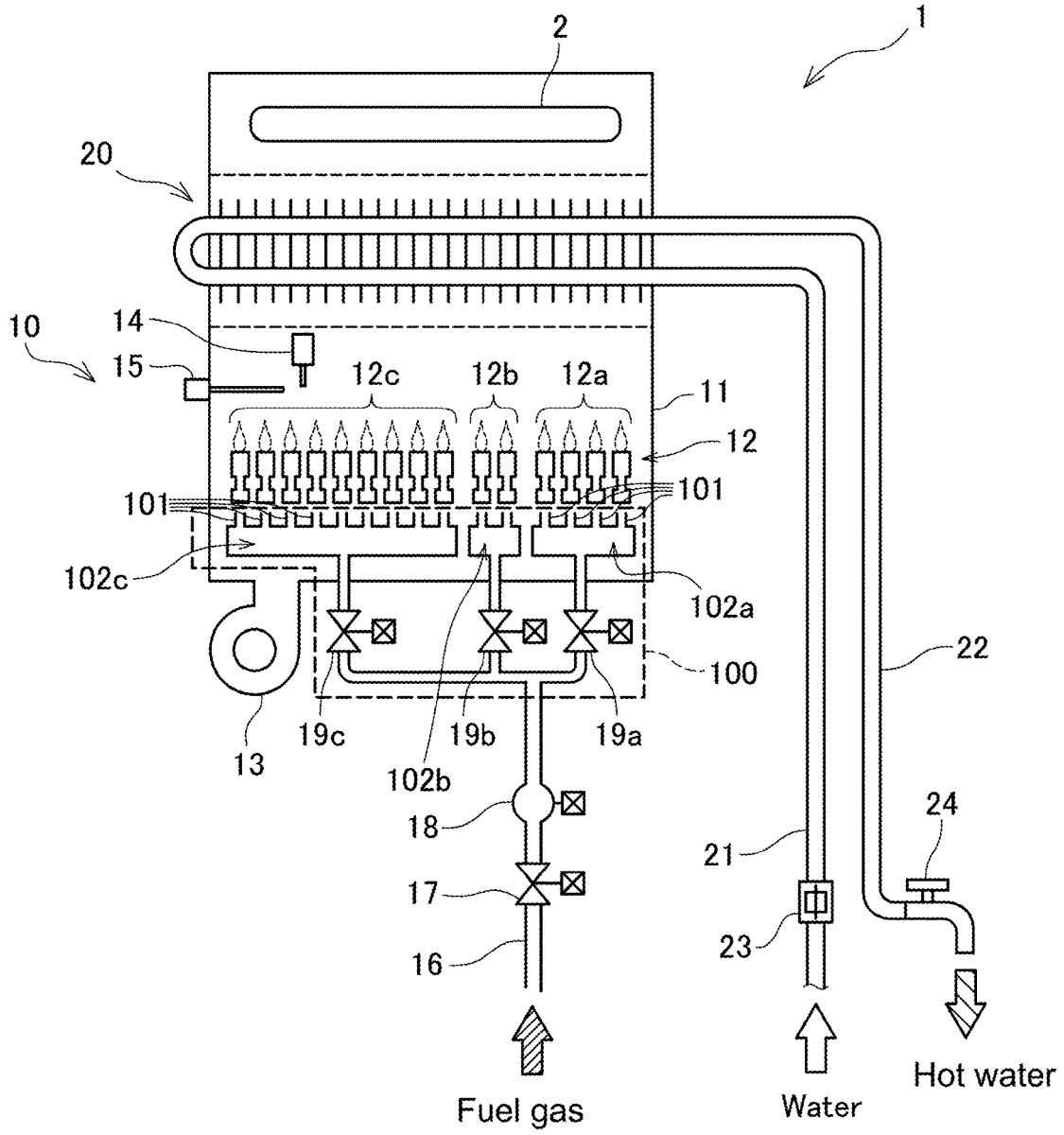
FIG. 1 is a diagram of a water heater 1 including a combustion apparatus 10.

FIG. 1 is a diagram of a water heater 1 including a combustion apparatus 10. The water heater 1 includes the combustion apparatus 10 that burns fuel gas, and a heat exchanger 20 that uses hot combustion gas generated in the combustion apparatus 10 to produce hot water. The heat exchanger 20 is connected to a water supply channel 21 that receives service water, and a hot-water supply channel 22 that feeds the hot water produced in the heat exchanger 20. The water supply channel 21 has, on its course, a flow sensor 23 that detects the flow rate of service water flowing into the heat exchanger 20. In addition, the hot-water supply channel 22 has a hot-water supply faucet 24 connected to its end.

The combustion apparatus 10 includes a combustion case 11 that defines a combustion chamber in its inner space, a plurality of burners 12 installed in the combustion case 11, a gas manifold 100 that feeds the burners 12 with fuel gas, a combustion fan 13 that feeds the combustion case 11 with combustion air for burning the fuel gas, a spark plug 14 that lights the burners 12, and a flame rod 15 that detects the flame of the burners 12. The gas manifold 100 is connected to a gas channel 16 that feeds the fuel gas, and the gas channel 16 includes, on its course, a main valve 17 that opens or closes the gas channel 16, and a proportional valve 18 that regulates the flow rate of the fuel gas to be fed to the gas manifold 100 downstream from the main valve 17.

As shown in FIG. 1, the combustion apparatus 10 according to the present embodiment includes 15 burners 12. The burners 12 are grouped into three burner sets 12*a* to 12*c* each including a different number of burners 12. In the illustrated example, the burner set 12*a* includes four adjacent burners 12, the burner set 12*b* includes two adjacent burners 12, and the burner set 12*c* includes nine adjacent burners 12.

The gas manifold 100 includes a plurality of nozzles 101 that feed the burners 12 with fuel gas. Each nozzle 101 is associated with one burner 12 in advance and feeds the burner 12 with the fuel gas. The gas manifold 100 also includes three internal distribution chambers 102*a* to 102*c*. The three distribution chambers 102*a* to 102*c* correspond to the three burner sets 12*a* to 12*c* described above. An electromagnetic on-off valve 19*a* is installed upstream from the distribution chamber 102*a*, an electromagnetic on-off valve 19*b* upstream from the distribution chamber 102*b*, and an electromagnetic on-off valve 19*c* upstream from the distribution chamber 102*c*. The electromagnetic on-off valves 19*a* to 19*c* may be open or closed to feed the distribution chambers 102*a* to 102*c* individually with the fuel gas. The electromagnetic on-off valves 19*a* to 19*c* in the present embodiment correspond to "on-off valves" in the aspects of the present invention.

As described above, each nozzle 101 feeds fuel gas to the specific burner 12 associated with it in advance, and the nozzles 101 that have received fuel gas from the distribution chamber 102*a* feed the fuel gas to the burners 12 in the burner set 12*a*. Likewise, the nozzles 101 that have received fuel gas from the distribution chamber 102*b* feed the fuel gas to the burners 12 in the burner set 12*b*, and the nozzles 101 that have received fuel gas from the distribution chamber 102*c* feed the fuel gas to the burners 12 in the burner set 12*c*. The electromagnetic on-off valves 19*a* to 19*c* may be open or closed to cause each of the burner sets 12*a* to 12*c* to individually start or stop feeding fuel gas to the burners 12. Each of the burner sets 12*a* to 12*c* may thus individually start or end the combustion of the fuel gas by the burners 12.

In the above water heater 1, when a user of the water heater 1 opens the hot-water supply faucet 24 on the hot-water supply channel 22, the heat exchanger 20 is fed with service water through the water supply channel 21. When the flow sensor 23 detects the flow rate of the service water reaching at least a predetermined flow rate, burners 12 start combustion. In accordance with intended thermal power, the degree of opening of the proportional valve 18 is controlled, and the electromagnetic on-off valves 19*a* to 19*c* are open or closed. This allows multi-level switching of the number of burners 12 to burn the fuel gas. The hot combustion gas generated in the combustion passes through the heat exchanger 20 above the combustion apparatus 10. During the passage, the hot combustion gas exchanges heat with the service water passing through the heat exchanger 20 to generate hot water, which flows through the hot-water supply channel 22 and out of the hot-water supply faucet 24. The combustion gas with the temperature lowered by the heat exchange is discharged from the water heater 1 through an outlet 2 above the heat exchanger 20.

Figure 2:
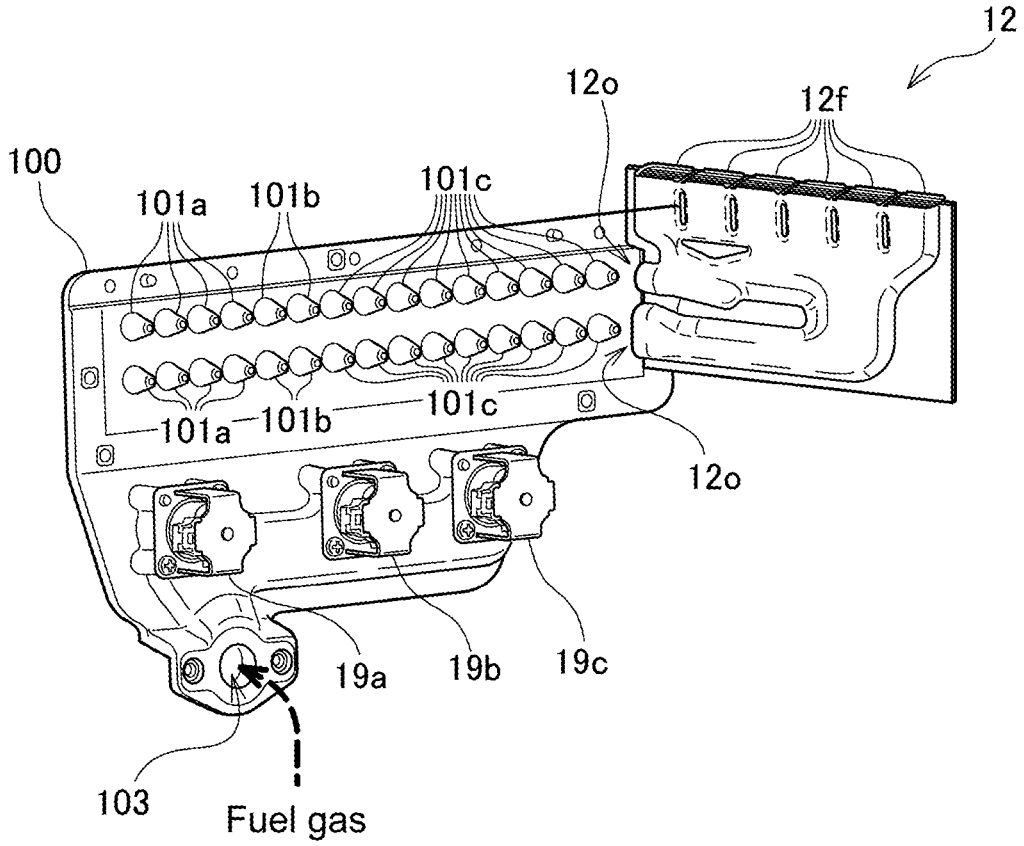
FIG. 2 is a view of a gas manifold 100 and a burner 12 according to an embodiment showing the positional relationship between them.

FIG. 2 is a view of the gas manifold 100 and a burner 12 according to the present embodiment showing the positional relationship between them. As described above, the water heater 1 according to the present embodiment includes the 15 burners 12. To simplify the drawing, FIG. 2 shows one burner 12 without the 14 other burners 12.

The burner 12 includes combined metal plates and has two gas inlets 12*o* (upper gas inlets 12*o* and lower gas inlets 12*o*) in its side surface to receive fuel gas. When injected into each gas inlet 12*o*, fuel gas flows into the burner 12 through the gas inlets 12*o* together with the surrounding air. The fuel gas and air mix in the burner 12 into mixed gas, and then the mixed gas flows out through a plurality of burner ports 12*f* formed in the top surface of the burner 12. The mixed gas is ignited with the spark plug 14 (refer to FIG. 1) to start combustion by the burner 12.

In correspondence with the two gas inlets 12*o* (upper and lower gas inlets) in the burner 12 according to the present embodiment, the nozzles 101 in the gas manifold 100 according to the present embodiment are arranged in two lines (or upper and lower lines). A pair of upper and lower nozzles 101 injects fuel gas into the upper and lower gas inlets 12*o* in the burner 12. As described above, the water heater 1 according to the present embodiment includes the 15 burners 12. Each burner 12 is associated with one pair of upper and lower nozzles 101, and thus the gas manifold 100 includes 30 (=15×2) nozzles 101 in total. As described above, the 15 burners 12 are grouped into the three burner sets 12*a* to 12*c*, and thus the 30 nozzles 101 for feeding fuel gas to the burners 12 can be grouped into a nozzle set 101*a* for feeding fuel gas to the burners 12 in the burner set 12*a*, a nozzle set 101*b* for feeding fuel gas to the burners 12 in the burner set 12*b*, and a nozzle set 101*c* for feeding fuel gas to the burners 12 in the burner set 12*c*.

As shown in FIG. 2, the three electromagnetic on-off valves 19*a* to 19*c* are attached below the nozzles 101. Under the electromagnetic on-off valves 19*a* to 19*c*, an inlet 103 is located to receive fuel gas. When the electromagnetic on-off valve 19*a* is open with the inlet 103 receiving fuel gas, the fuel gas is fed through the gas manifold 100 and the nozzles 101 in the nozzle set 101*a* to the burners 12 in the burner set 12*a*. Likewise, when the electromagnetic on-off valve 19*b* is open, the fuel gas is fed through the gas manifold 100 and the nozzles 101 in the nozzle set 101*b* to the burners 12 in the burner set 12*b*. When the electromagnetic on-off valve 19*c* is open, the fuel gas is fed through the gas manifold 100 and the nozzles 101 in the nozzle set 101*c* to the burners 12 in the burner set 12*c*. The internal structure of the gas manifold 100 will be described later.

Figure 3:
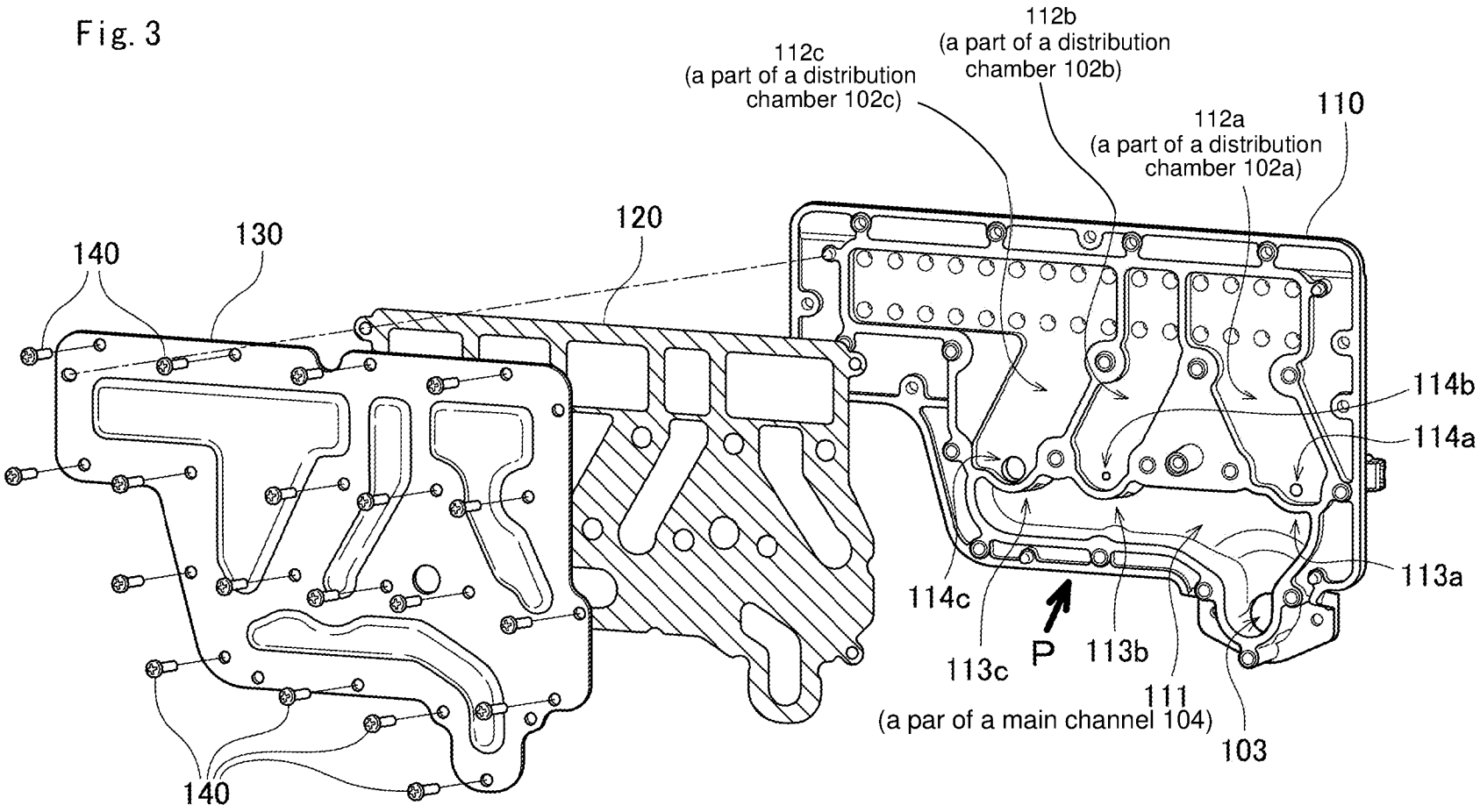
FIG. 3 is an exploded view of the gas manifold 100 according to the embodiment.

FIG. 3 is an exploded view of the gas manifold 100 according to the present embodiment. As shown in the figure, the gas manifold 100 includes a die-cast or cast manifold body 110, a sealing member 120 formed from a compressible material such as rubber, and a sheet-metal manifold cover 130 attached to the manifold body 110 with multiple mounting screws 140 with the sealing member 120 between the manifold body 110 and the manifold cover 130. The manifold cover 130, which is formed from sheet-metal in the present embodiment, may be die-cast or cast.

As shown in the figure, the manifold body 110 has three recesses 112*a* to 112*c* located in line and a channel groove 111 immediately below the recesses 112*a* to 112*c*. When the manifold cover 130 is fitted to the manifold body 110 with the sealing member 120 between them, the recess 112*a* is covered with the manifold cover 130 to define the distribution chamber 102*a* (refer to FIG. 1). The recess 112*b* defines the distribution chamber 102*b* (refer to FIG. 1), and the recess 112*c* defines the distribution chamber 102*c* (refer to FIG. 1). In FIG. 3, the numeral in parentheses (102*a*) below the recess 112*a* indicates that the recess 112*a* will form the distribution chamber 102*a* when the manifold cover 130 is attached to it. Likewise, in FIG. 3, the numeral (102*b*) below the recess 112*b* indicates that the recess 112*b* will form the distribution chamber 102*b*, and the numeral (102*c*) below the recess 112*c* indicates that the recess 112*c* will form the distribution chamber 102*c*. In addition, the sealing member 120 and the manifold cover 130 are fitted to the manifold body 110 to define a main channel 104 at a position corresponding to the channel groove 111 on the manifold body 110. In FIG. 3, the numeral (104) below the channel groove 111 indicates that the channel groove 111 will form the main channel 104.

The recess 112*a* also has, in its lower part (adjacent to the channel groove 111), a valve port 114*a* for the electromagnetic on-off valve 19*a* (refer to FIG. 2), and the valve port 114*a* connects to the valve chamber for the electromagnetic on-off valve 19*a*. Likewise, the recess 112*b* has, in its lower part, a valve port 114*b* for the electromagnetic on-off valve 19*b* (refer to FIG. 2), and the recess 112*c* has, in its lower part, a valve port 114*c* for the electromagnetic on-off valve 19*c* (refer to FIG. 2). The valve port 114*b* connects to the valve chamber for the electromagnetic on-off valve 19*b*, and the valve port 114*c* connects to the valve chamber for the electromagnetic on-off valve 19*c*.

In addition, the valve chambers for the electromagnetic on-off valves 19*a* to 19*c* each have an opening in the side corresponding to the side wall of the channel groove 111. An opening 113*b* in FIG. 3 in the side wall of the channel groove 111 connects to the valve chamber for the electromagnetic on-off valve 19*b*. An opening 113*c* in FIG. 3 in the side wall of the channel groove 111 connects to the valve chamber for the electromagnetic on-off valve 19*c*. An opening 113*a* in the side wall of the channel groove 111 also connects to the valve chamber for the electromagnetic on-off valve 19*a* although the opening 113*a* is not shown in FIG. 3.

Figure 4:
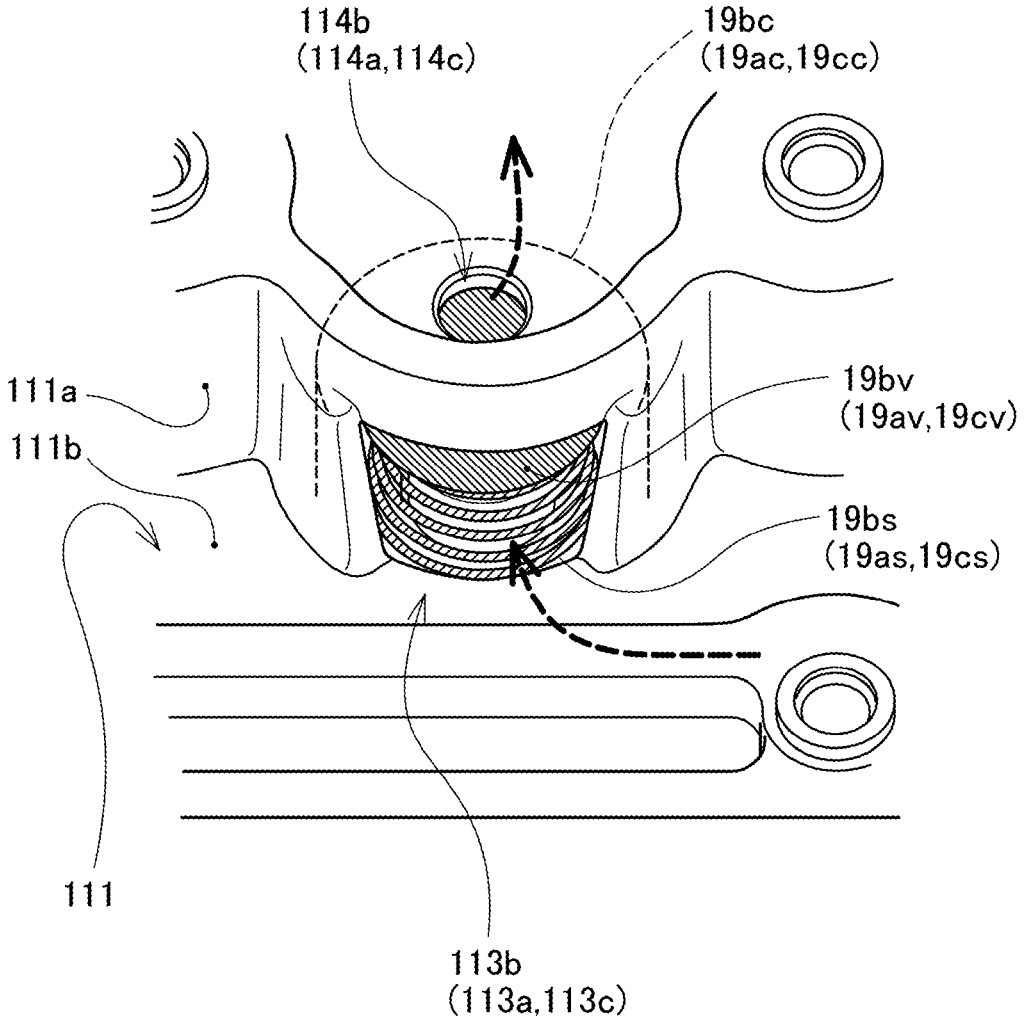
FIG. 4 is a perspective view of a channel groove 111 showing the detailed shape of an opening 113*b* in its side wall.

FIG. 4 is a perspective view of the channel groove 111 showing the detailed shape of the opening 113*b* in its side wall as viewed in the direction indicated by arrow P in FIG. 3. The opening 113*a* and the opening 113*c* have the same shape as the opening 113*b* and are not shown. In FIG. 4, the numerals in parentheses (113*a*, 113*c*) below the opening 113*b* indicate that the opening 113*b* represents these openings.

As shown in FIG. 4, the channel groove 111 has a side wall 111*a* and a bottom 111*b*, and the opening 113*b* in the side wall 111*a* at a position adjacent to the bottom 111*b*. The opening 113*b* connects to a valve chamber 19*bc* for the electromagnetic on-off valve 19*b* (refer to FIG. 2). The valve chamber 19*bc* accommodates a valve element 19*bv* of the electromagnetic on-off valve 19*b*. The valve element 19*bv* is urged against the valve port 114*b* by a spring 19*bs* for the electromagnetic on-off valve 19*b*. In FIG. 4, the numerals in parentheses (114*a*, 114*c*) below the valve port 114*b* indicate that the valve port 114*b* represents the valve port 114*a* and the valve port 114*c*. In FIG. 4, the numerals (19*ac*, 19*cc*) below the valve chamber 19*bc* indicate that the valve chamber 19*bc* represents a valve chamber 19*ac* and a valve chamber 19*cc*, and the numerals (19*av*, 19*cv*) below the valve element 19*bv* indicate that the valve element 19*bv* represents a valve element 19*av* and a valve element 19*cv*. In addition, the numerals (19*as*, 19*cs*) below the spring 19*bs* indicate that the spring 19*bs* represents a spring 19*as* and a spring 19*cs*.

In this manner, the channel groove 111 connects to the recess 112*a* (refer to FIG. 3) through the opening 113*a*, the valve chamber 19*ac*, and the valve port 114*a*. Thus, the electromagnetic on-off valve 19*a* shown in FIG. 2 is open to define a channel connecting the channel groove 111 and the recess 112*a*. The channel from the channel groove 111 to the recess 112*a* corresponds to "a distribution channel" in the aspects of the present invention. Likewise, the electromagnetic on-off valve 19*b* is open to define a channel connecting the channel groove 111 and the recess 112*b* (refer to FIG. 3). The electromagnetic on-off valve 19*c* is open to define a channel connecting the channel groove 111 and the recess 112*c* (refer to FIG. 3). The channel from the channel groove 111 to the recess 112*b* and the channel from the channel groove 111 to the recess 112*c* also correspond to "distribution channels" in the aspects of the present invention.

Figures 5, 6:
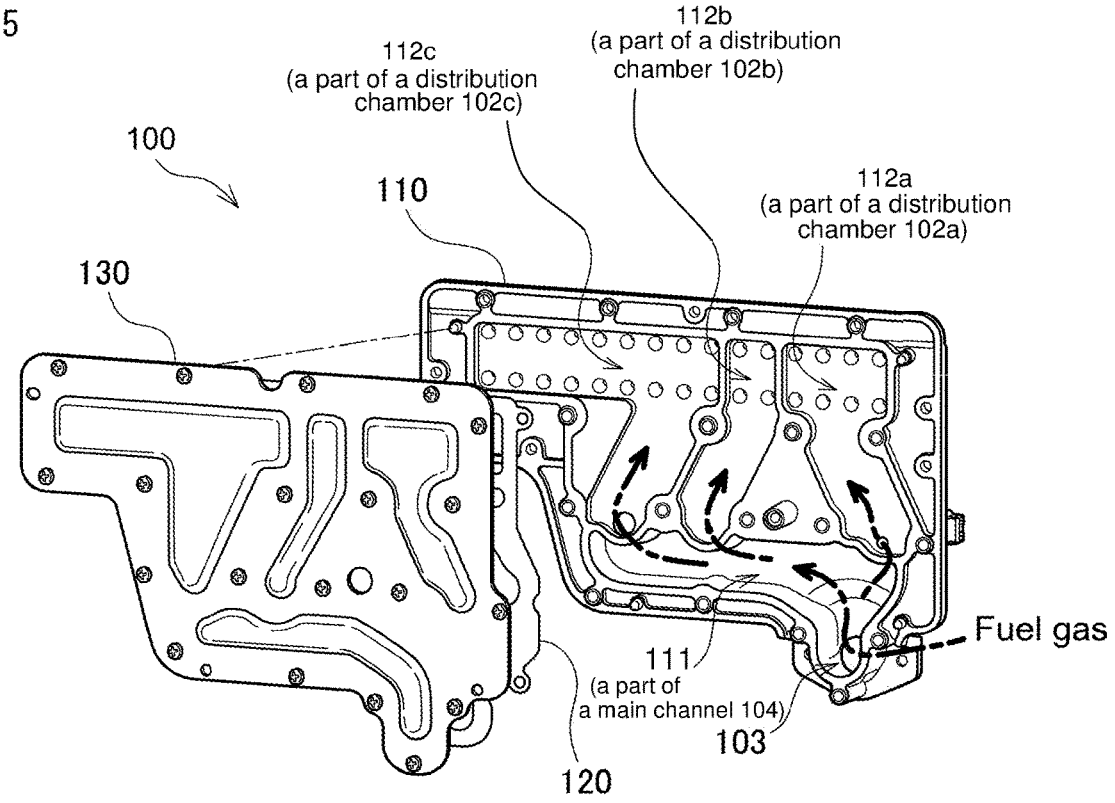
FIG. 5 is a view of the gas manifold 100 describing the distribution of fuel gas flowing in through an inlet 103 to distribution chambers 102*a* to 102*c* through a main channel 104.
FIG. 6 is a diagram describing a comparison between the numbers of burners 12 fed with fuel gas from the distribution chambers 102*a* to 102*c* in the gas manifold 100 according to the embodiment.

FIG. 5 is a view of the gas manifold 100 describing the distribution of fuel gas flowing in the gas manifold 100 through the inlet 103 to the distribution chambers 102*a* to 102*c* through the main channel 104. FIG. 5 shows the gas manifold 100 divided between the manifold body 110 and the sealing member 120 for easy understanding of flows of fuel gas passing through the main channel 104. Thus, the channel groove 111 corresponds to the main channel 104, and the recesses 112*a* to 112*c* correspond to the distribution chambers 102*a* to 102*c*. As indicated by thick dash-dot arrows in FIG. 5, fuel gas passes through the channel groove 111 after flowing through the inlet 103 into the channel groove 111. As described above with reference to FIG. 4, the fuel gas is distributed to the recesses 112*a* to 112*c* (or the distribution chambers 102*a* to 102*c*) through the openings 113*a* to 113*c*, the valve chambers 19*ac* to 19*cc*, and the valve ports 114*a* to 114*c*.

As described above with reference to FIG. 1 or 2, the distribution chamber 102*a* feeds the four burners 12 with the fuel gas. The distribution chamber 102*b* feeds the two burners 12 with the fuel gas. The distribution chamber 102*c* feeds the nine burners 12 with the fuel gas. Each burner 12 burns fuel gas at the same maximum flow rate, and the flow rates of fuel gas to be fed to the distribution chambers 102*a* to 102*c* rise as the number of burners 12 to burn the fuel gas increases. Thus, as shown in FIG. 6, a comparison between the distribution chamber 102*b* including the smallest number of burners 12 and the distribution chamber 102*c* including the largest number of burners 12 shows as large as a 4.5-fold difference (=9/2) in the flow rates of fuel gas to be fed to these distribution chambers. The distribution chamber including the largest number of burners 12 (the distribution chamber 102*c* in this embodiment) will be referred to as "the maximum distribution chamber". The distribution chamber 102 including the smallest number of burners 12 (the distribution chamber 102*b* in this embodiment) will be referred to as "the minimum distribution chamber".

As described above with reference to FIG. 4, the main channel 104 connects to the distribution chambers 102*a* to 102*c* through the openings 113*a* to 113*c*, the valve chambers 19*ac* to 19*cc*, and the valve ports 114*a* to 114*c*. Moreover, the valve chambers 19*ac* to 19*cc* accommodate the valve elements 19*av* to 19*cv* and the springs 19*as* to 19*cs* of the electromagnetic on-off valves 19*a* to 19*c*. Thus, increasing the size of the valve ports 114*a* to 114*c* or the electromagnetic on-off valves 19*a* to 19*c* may not prevent a certain channel resistance. With about a 4.5-fold difference in the flow rate of fuel gas to be fed between the maximum distribution chamber (the distribution chamber 102*c* in this embodiment) and the minimum distribution chamber (the distribution chamber 102*b* in this embodiment), the channel resistance that cannot be reduced by the increase of the size may cause shortage of the fuel gas to be fed to the maximum distribution chamber. This can cause inappropriate flow rates of fuel gas to the distribution chambers 102*a* to 102*c*. To distribute fuel gas at appropriate flow rates to the distribution chambers 102*a* to 102*c*, the gas manifold 100 according to the present embodiment has the structure below.

Figure 7:
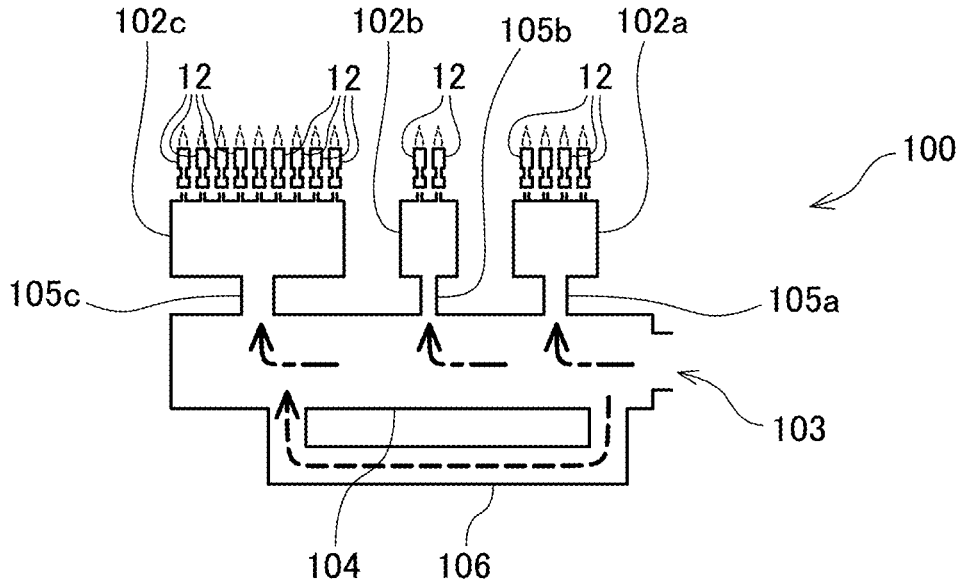
FIG. 7 is a diagram describing a basic mechanism for allowing fuel gas at appropriate flow rates to be distributed to the distribution chambers 102*a* to 102*c* through the gas manifold 100 according to the embodiment.

FIG. 7 is a diagram describing a basic mechanism for allowing fuel gas at appropriate flow rates to be distributed to the distribution chambers 102*a* to 102*c* through the gas manifold 100 according to the present embodiment. As described above, after flowing into the main channel 104 through the inlet 103, the fuel gas flows into the distribution chambers 102*a* to 102*c* from the main channel 104. FIG. 7 shows a distribution channel 105*a* representing the channel from the main channel 104 to the distribution chamber 102*a* described above with reference to FIG. 4 (or the passage from the opening 113*a* through the valve chamber 19*ac* to the valve port 114*a*). Likewise, a distribution channel 105*b* represents the channel from the main channel 104 to the distribution chamber 102*b* (the passage from the opening 113*b* through the valve chamber 19*bc* to the valve port 114*b*). A distribution channel 105*c* represents the channel from the main channel 104 to the distribution chamber 102*c* (the passage from the opening 113*c* through the valve chamber 19*cc* to the valve port 114*c*). The distribution channel 105*c* may be referred to as the maximum distribution channel, because this channel is connected to the maximum distribution chamber. Likewise, the distribution channel 105*b* is connected to the distribution chamber 102*b*, which is the minimum distribution chamber. The distribution channel 105*b* may thus be referred to as the minimum distribution channel.

The fuel gas flowing in the main channel 104 is, as indicated by thick dash-dot arrows in FIG. 7, distributed first to the distribution chamber 102*a* through the distribution channel 105*a* and then to the distribution chamber 102*b* through the distribution channel 105*b*, and the remaining fuel gas is distributed to the distribution chamber 102*c* through the distribution channel 105*c*. Thus, an increase in the flow rate of fuel gas fed to the distribution channel 105*a* or the distribution channel 105*b* may cause a shortage in the fuel gas fed to the distribution chamber 102*c*. To avoid such situations, the valve port 114*c* and the electromagnetic on-off valve 19*c* may be upsized to reduce the channel resistance of the distribution channel 105*c*. However, the degree of reduction in the channel resistance is limited. Thus, such a situation may not be avoided sufficiently by reducing the channel resistance of the distribution channel 105*b* or the distribution channel 105*c*. Because of this, in many cases, the flow rate of the distribution channel 105*c* may need to be increased by increasing the channel resistances of the distribution channel 105*a* and the distribution channel 105*b*. However, an increase in the channel resistances of the distribution channel 105*a* and the distribution channel 105*b* may cause a shortage in the fuel gas fed to the distribution chamber 102*a* and the distribution chamber 102*b*.

The gas manifold 100 according to the present embodiment thus, as shown in FIG. 7, includes a bypass channel 106 parallel with the main channel 104, allowing the distribution chamber 102*c*, which is the maximum distribution chamber, to be fed with fuel gas also from the bypass channel 106. The bypass channel 106 illustrated in FIG. 7 branches from the main channel 104 immediately downstream from the inlet 103 (or upstream from the branch of the distribution channel 105*a*), and rejoins the main channel 104 immediately upstream from the branch of the distribution channel 105*c* (or downstream from the branch of the distribution channel 105*b*). As indicated by thick dash-dot arrows in FIG. 7, the distribution chamber 102*c*, which is the maximum distribution chamber, is fed with fuel gas from the bypass channel 106 as well as the main channel 104. The distribution chamber 102*c* is thus fed with fuel gas at a sufficient flow rate without increasing the channel resistance of the distribution channel 105*a* or the distribution channel 105*b*.

The bypass channel 106 bypasses the branches of the distribution channel 105*a* and the distribution channel 105*b* from the main channel 104. The flow rate of fuel gas flowing in the bypass channel 106 is less likely to be affected by the flow rate of fuel gas fed to the distribution chamber 102*a* or the distribution chamber 102*b*. Thus, the distribution chamber 102*c* (the maximum distribution channel) is fed with fuel gas at a stable flow rate irrespective of the feeding state of fuel gas into the distribution chamber 102*a* and the distribution chamber 102*b*.

In the example shown in FIG. 7, the bypass channel 106 bypasses all the distribution channels (the distribution channel 105*a* and the distribution channel 105*b* in this embodiment) other than the maximum distribution channel (the distribution channel 105*c* in this embodiment). In some embodiments, the bypass channel 106 may bypass selected ones of the distribution channels (the distribution channel 105*a* or the distribution channel 105*b* in this embodiment) other than the maximum distribution channel. For example, the branch of the bypass channel 106 from the main channel 104 may be downstream from the branch of another distribution channel (e.g., the distribution channel 105*a*). In this case, the bypass channel 106 bypasses the distribution channel that branches downstream from the branch point of the bypass channel 106 from the main channel 104. In some embodiments, the bypass channel 106 may rejoin the main channel 104 upstream from the branch of another distribution channel (e.g., the distribution channel 105*b*). In this case, the bypass channel 106 bypasses the distribution channel that branches downstream from the rejoining point of the bypass channel 106 to the main channel 104. In some embodiments, the branch of the maximum distribution channel (the distribution channel 105*c* in this embodiment) may not be the most downstream position of the main channel 104, but the branch of another distribution channel from the main channel 104 may be downstream from the maximum distribution channel. In this case, the bypass channel 106 bypasses the distribution channel that branches downstream from the branch point of the maximum distribution channel from the main channel 104. In these embodiments as well, with any distribution channel(s) bypassed by the bypass channel 106, the distribution chamber 102*c* (the maximum distribution chamber) is fed with fuel gas irrespective of fuel gas fed through the bypassed distribution channel to the distribution chamber. The distribution chamber 102*c* is thus fed with fuel gas at a sufficient flow rate stably.

Figure 8:
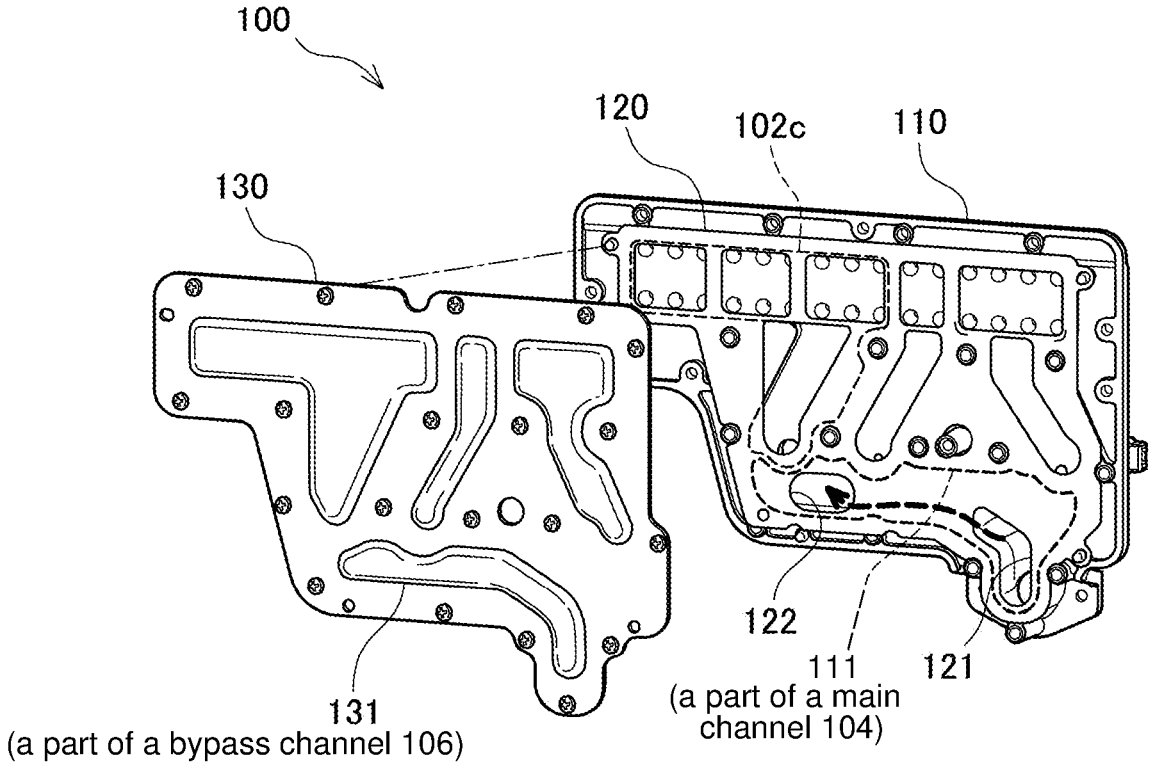
FIG. 8 is a view of the gas manifold 100 according to the embodiment describing a bypass channel 106 in the manifold.

FIG. 8 is a view of the gas manifold 100 according to the present embodiment describing the bypass channel 106 in the manifold. FIG. 8 shows the gas manifold 100 divided into the manifold cover 130 and the manifold body 110 with the sealing member 120. As shown in the figure, the sealing member 120 is shaped to cover the channel groove 111 (in FIG. 8, the channel groove 111 is indicated by a dashed line in the figure) on the manifold body 110. The part of the sealing member 120 covering the channel groove 111 has a first hole 121 at an upstream position (adjacent to the inlet 103) of the channel groove 111, and a second hole 122 at a downstream position (adjacent to the branch of the distribution channel 105*c*) of the channel groove 111. In addition, the manifold cover 130 has a bypass groove 131 that is a recess on the surface facing the sealing member 120. The bypass groove 131 extends between the position corresponding to the first hole 121 and the position corresponding to the second hole 122 in the sealing member 120.

Thus, when the manifold cover 130 is fitted to the manifold body 110 with the sealing member 120 between them, the channel groove 111 is covered with the sealing member 120 to define the main channel 104, and a channel is defined between the bypass groove 131 on the manifold cover 130 and the sealing member 120. This channel connects to an upstream area of the main channel 104 through the first hole 121 in the sealing member 120 and to a downstream area of the main channel 104 through the second hole 122, and thus serves as the bypass channel 106. When the main channel 104 is fed with fuel gas through the inlet 103 as described above (refer to FIG. 5), the fuel gas is partly fed to the distribution chamber 102*c* (the maximum distribution chamber) through the bypass channel 106. FIG. 8 shows a thick dashed arrow indicating the flow of fuel gas passing through the bypass channel 106.

As described above, the gas manifold 100 according to the present embodiment includes the bypass channel 106 defined between the manifold cover 130 and the sealing member 120, allowing the distribution chamber 102*c* (the maximum distribution chamber) to be fed with fuel gas from the bypass channel 106 as well as the main channel 104. The mechanism described above with reference to FIG. 7 allows the distribution chambers 102*a* to 102*c* to be fed with fuel gas at appropriate flow rates.

In the present embodiment, the bypass channel 106 defined between the manifold cover 130 and the sealing member 120 eliminates the space in the manifold body 110 to be used for the bypass channel 106. Thus, the manifold body 110 is designed easily.

Figure 9:
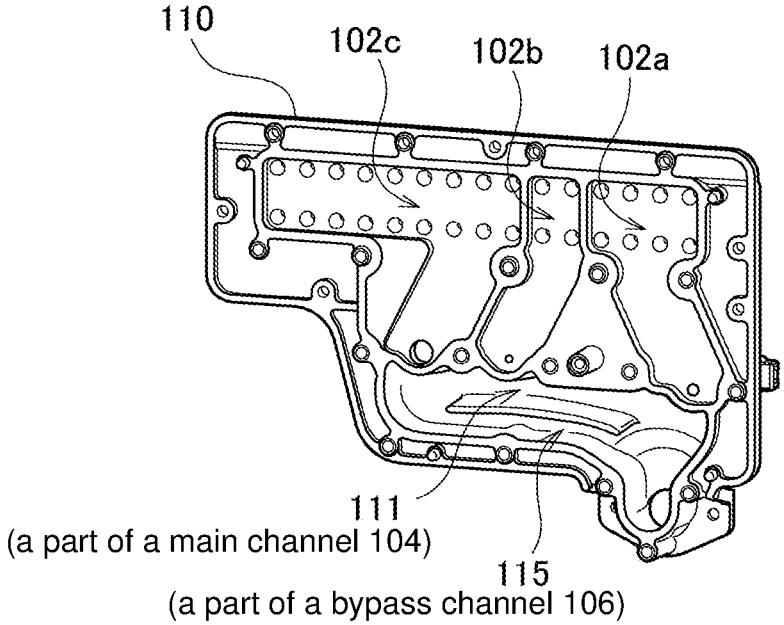
FIG. 9 is a view illustrating the manifold body 110 in which a bypass groove 115 is located.

The gas manifold 100 according to the present embodiment includes the bypass channel 106 between the manifold cover 130 and the sealing member 120. However, the bypass channel 106 may not be defined between the manifold cover 130 and the sealing member 120. For example, as illustrated in FIG. 9, the manifold body 110 may have a bypass groove 115 parallel with the channel groove 111. In this example, when the manifold cover 130 is fitted to the manifold body 110, the channel groove 111 defines the main channel 104, and the bypass groove 115 defines the bypass channel 106.

Although the gas manifold 100 according to the present embodiment has been described, the present invention is not limited to the above embodiment, but may be modified variously without departing from the spirit and scope of the present invention.

REFERENCE SIGNS LIST

1 water heater
2 outlet
10 combustion apparatus
11 combustion case
12 burner
12*a* to 12*c* burner set
12*f* burner port
12*o* gas inlet
13 combustion fan
14 spark plug
15 flame rod
16 gas channel
17 main valve
18 proportional valve
19*a* to 19*c* electromagnetic on-off valve
19*ac* to 19*cc* valve chamber
19*as* to 19*cs* spring
19*av* to 19*cv* valve element
20 heat exchanger
21 water supply channel
22 hot-water supply channel
23 flow sensor
24 hot-water supply faucet
100 gas manifold
101 nozzle
101*a* to 101*c* nozzle set
102*a* to 102*c* distribution chamber
103 inlet
104 main channel
105*a* to 105*c* distribution channel
106 bypass channel
110 manifold body
111 channel groove
111*a* side wall
111*b* bottom
112*a* to 112*c* recess
113*a* to 113*c* opening
114*a* to 114*c* valve port
115 bypass groove
120 sealing member
121 first hole
122 second hole
130 manifold cover
131 bypass groove
140 mounting screw

The invention claimed is:

1. A gas manifold installable in a combustion apparatus to distribute fuel gas to a plurality of burners for burning the fuel gas included in the combustion apparatus, the plurality of burners being grouped into a plurality of burner sets, the combustion apparatus performing stepwise switching of the number of burners to burn the fuel gas by causing each of the plurality of burner sets to burn the fuel gas, the gas manifold comprising:

an inlet configured to receive the fuel gas fed from outside;

a main channel configured to allow passage of the fuel gas flowing in through the inlet;

a plurality of distribution chambers each located for a corresponding burner set of the plurality of burner sets, the plurality of distribution chambers being configured to receive, from the main channel, the fuel gas to be fed to the plurality of burners in the plurality of burner sets;

a plurality of nozzles each located for a corresponding burner of the plurality of burners, the plurality of nozzles being configured to feed the plurality of burners with the fuel gas flowing into the plurality of distribution chambers;

a plurality of distribution channels branching from the main channel and connecting the main channel to the plurality of distribution chambers;

a plurality of on-off valves each located at a corresponding distribution channel of the plurality of distribution channels to open or close the corresponding distribution channel; and a bypass channel branching from a first part of the main channel downstream from the inlet, bypassing a second part of the main channel, and rejoining a third part of the main channel, wherein the second part of the main channel is located at a branch of at least one of the plurality of distribution channels from the main channel.

2. The gas manifold according to claim 1, wherein the plurality of distribution chambers include a maximum distribution chamber and distribution chambers other than the maximum distribution chamber, and the maximum distribution chamber includes more burners in the corresponding burner set than each of the other distribution chambers, and the bypass channel rejoins the main channel upstream from a branch of a maximum distribution channel from the main channel, and the maximum distribution channel is a distribution channel included in the plurality of distribution channels and connected to the maximum distribution chamber.

3. The gas manifold according to claim 2, wherein the plurality of distribution chambers include a minimum distribution chamber and distribution chambers other than the minimum distribution chamber, and the minimum distribution chamber includes fewer burners in the corresponding burner set than each of the other distribution chambers, the minimum distribution chamber is connected to a minimum distribution channel being a distribution channel included in the plurality of distribution channels, and the minimum distribution channel branches from the main channel upstream from the maximum distribution channel, and the bypass channel rejoins the main channel downstream from a branch of the minimum distribution channel from the main channel.

4. The gas manifold according to claim 2, wherein a branch of the maximum distribution channel from the main channel is disposed at an outer side of branches of the other distribution channels from the main channel, and the bypass channel rejoins the main channel between the branch of the maximum distribution channel from the main channel and a branch of a distribution channel adjacent to the maximum distribution channel from the main channel.

5. The gas manifold according to claim 1, wherein the main channel is defined by a manifold cover placed over a channel groove on a manifold body, the plurality of distribution chambers are defined by the manifold cover placed over a plurality of recesses adjacent to the channel groove on the manifold body, the manifold cover and the manifold body hold a sealing member therebetween, the sealing member has a portion covering the channel groove on the manifold body and having a first hole and a second hole at different positions along the channel groove, and the manifold cover has a bypass groove connecting to the channel groove on the manifold body through the first hole and the second hole in the sealing member to define the bypass channel.

6. The gas manifold according to claim 5, wherein the inlet configured to receive the fuel gas flowing into the main channel is open from the manifold body to the manifold cover.

* * * * *